US005211396A

United States Patent [19]

Ferrari et al.

[11] Patent Number: 5,211,396

[45] Date of Patent: May 18, 1993

[54] MULTI-FRAME RACKET

[75] Inventors: Matthew F. Ferrari; Harry M. Ferrari; John M. Shallenberger, all of Pittsburgh, Pa.

[73] Assignee: Ferrari Importing Company, Pittsburgh, Pa.

[21] Appl. No.: 657,718

[22] Filed: Feb. 19, 1991

Related U.S. Application Data

[62] Division of Ser. No. 495,231, Mar. 16, 1990.

[51] Int. Cl.[5] ..... A63B 49/02

[52] U.S. Cl. ..... 273/73 C; 273/73 G

[58] Field of Search ..... 273/73 R, 73 C, 73 F, 273/73 G, 73 H, 73 K, 73 L

[56] References Cited

U.S. PATENT DOCUMENTS

| | | | |
|---|---|---|---|
| D. 232,106 | 7/1974 | Dana | 273/73 C X |
| D. 257,484 | 11/1980 | Drake | D21/212 |
| 1,381,050 | 6/1921 | Agutter | 273/73 K |
| 1,831,413 | 11/1931 | Hall | 273/73 G |
| 2,085,960 | 7/1937 | Donisthorpe | 273/73 R |
| 2,171,223 | 8/1939 | Robinson | 278/73 |
| 2,178,588 | 11/1939 | Kleinman | 273/73 G X |
| 3,528,658 | 3/1968 | Cheris et al. | 273/73 C |
| 3,545,756 | 12/1970 | Nash | 273/73 C |
| 3,633,910 | 1/1972 | Spenle | 273/73 C |
| 3,647,211 | 3/1972 | Doessel et al. | 273/73 C |
| 3,707,288 | 12/1972 | Edlefsen | 273/73 L |
| 3,814,423 | 6/1974 | Shockley et al. | 273/73 K X |
| 4,023,799 | 5/1977 | Van Auken | 273/73 C X |
| 4,027,881 | 6/1977 | Hufenas | 273/73 R |
| 4,094,505 | 6/1978 | Beall | 273/73 C |
| 4,139,194 | 2/1979 | Fischer | 273/73 C |
| 4,180,263 | 12/1979 | Haines | 273/73 |
| 4,185,822 | 1/1980 | Li | 273/73 L |
| 4,192,505 | 3/1980 | Tabickman et al. | 273/73 C |
| 4,274,634 | 6/1981 | Berluti | 273/73 L |
| 4,278,251 | 7/1981 | Lafourcade | 273/73 G |
| 4,293,129 | 10/1981 | Planakis | 273/67 R |
| 4,326,714 | 4/1982 | Novack | 273/73 C |
| 4,331,331 | 5/1982 | Rodgers, Jr. | 273/73 K |
| 4,436,305 | 3/1984 | Fernandez | 273/73 C |
| 4,440,392 | 4/1984 | Popplewell | 273/73 C |
| 4,531,738 | 7/1985 | Mortvedt et al. | 273/73 C |
| 4,634,124 | 1/1987 | Yuhas et al. | 273/73 G |
| 4,664,380 | 5/1987 | Kuebler | 273/73 C |
| 4,768,786 | 9/1988 | Kuebler | 273/73 C |

FOREIGN PATENT DOCUMENTS

| | | | |
|---|---|---|---|
| 431394 | 7/1935 | United Kingdom | 273/73 G |

*Primary Examiner*—William H. Grieb
*Assistant Examiner*—William E. Stoll
*Attorney, Agent, or Firm*—Michael R. Swartz; John R. Flanagan

[57] ABSTRACT

A sports racket has a handle and a multi-frame. The multi-frame includes a primary frame defining a throat connected to the handle and a hoop-shaped head connected to the throat and encompassing an open region. The head has a plurality of stringing holes defined therethrough for attaching stringing to the head and across the open region. The multi-frame also includes supplementary frames and ribs. The supplementary frames are disposed in spaced relation and adjacent to opposite sides of the primary frame. The supplementary frames are coextensive with all or a portion of the primary frame head, plus all or a portion of the primary frame throat. The ribs are spaced from one another and extend between and rigidly interconnect the supplementary frames with coextensive portions of the primary frame. The ribs and supplementary frames serve to increase the stiffness of the primary frame, reducing axial and torsional deflections thereof upon striking a ball by the stringing across the open region of the head. The multi-frame further includes supplementary bracing interconnecting portions of the supplementary frames alone or with the primary frame in the region of the throat thereof.

20 Claims, 13 Drawing Sheets

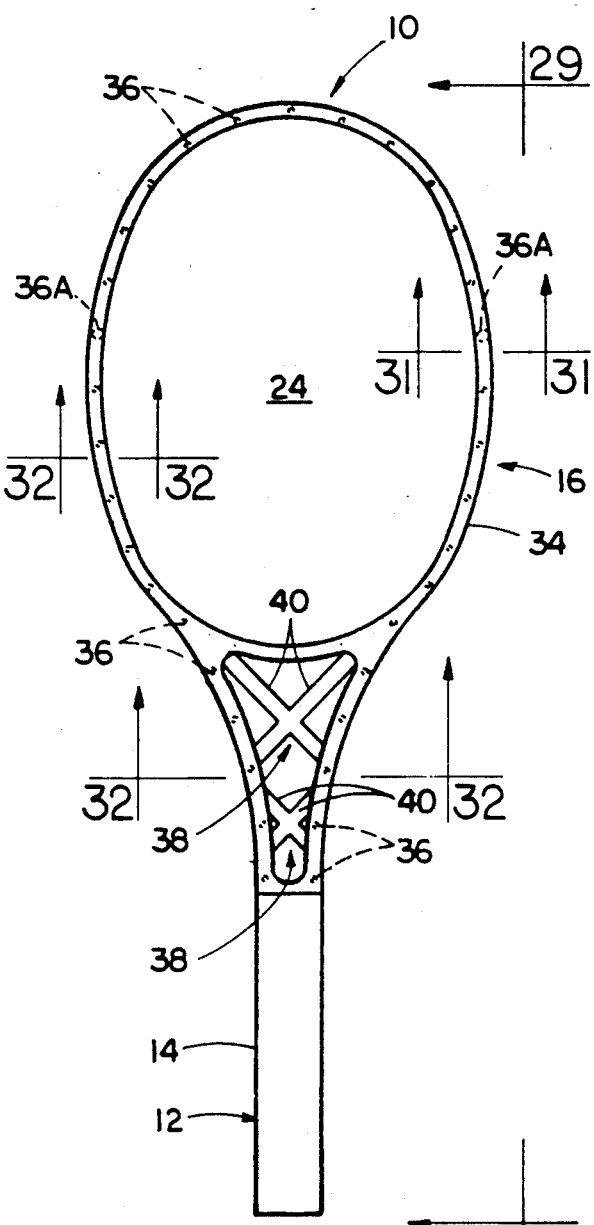
FIG. 28
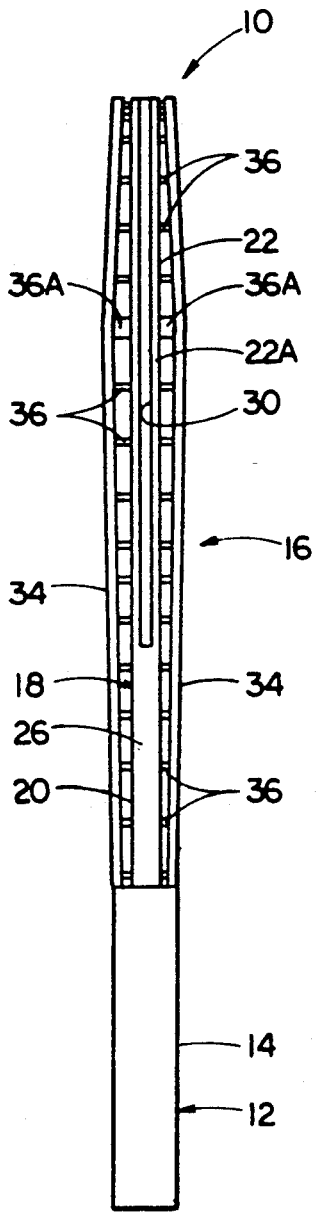
FIG. 29
FIG. 30
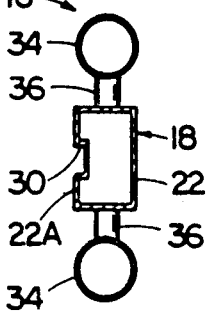
FIG. 31
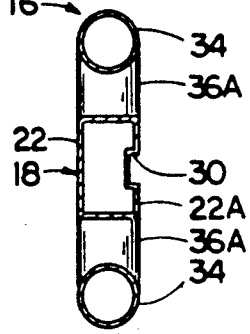
FIG. 32
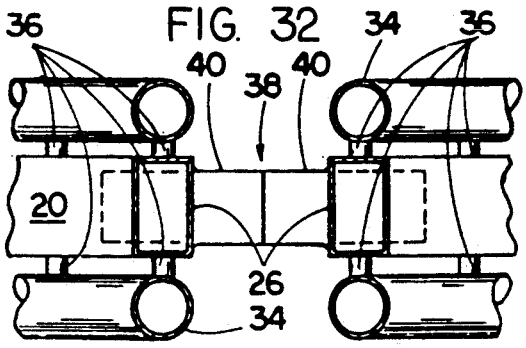

MULTI-FRAME RACKET

This is a division of application Ser. No. 07/495,231, filed Mar. 16, 1990 pending.

CROSS REFERENCE TO RELATED APPLICATIONS

Reference is hereby made to the following copending application dealing with related subject matter and assigned to the assignee of the present invention:

1. "Racket Frame Having Holes For Tailoring Frame Stiffness" by Harry M. Ferrari et al, assigned U.S. Ser. No. 303,782 and filed Jan. 27, 1989. (BH-3).

2. "Racket Frame Having Multi-Dimensional Cross-Sectional Configuration" by Ronald H. Carr, assigned U.S. Ser. No. 07/449,198 and filed Dec. 8, 1989. (BH-5).

BACKGROUND OF THE INVENTION

1. Field of the Invention

The present invention generally relates to rackets for use in games and, more particularly, is concerned with a racket having a multi-frame construction.

2. Description of the Prior Art

A conventional game racket frame, such as a tennis racket frame, is ordinarily an integral structure which includes a head portion, a throat portion and a handle portion. Typically, the racket frame is fabricated of composite-type material composed of high modulus fibers such as graphite fibers or glass fibers in a matrix of an epoxy resin. Also, racket frames have been fabricated from other materials, such as aluminum, wood and plastics.

The head portion of the racket frame typically has a round or oval configuration and contains a plurality of holes aligned in a common plane for applying stringing under tension and in a grid pattern across the head portion to provide a ball striking area of the racket. The handle portion of the racket frame is usually covered with an outer sheath for facilitating gripping of the racket by the user's hand.

The construction of a conventional tennis racket poses several shortcomings to achievement of ball striking accuracy. In one common constructional feature, the height of the handle portion is greater than the height of the head portion measured in a direction normal to the plane of the stringing across the head portion. This common feature contributes to inaccuracy of ball striking directional aim as a result of deflecting of the racket head portion away from the longitudinal axis of the racket in response to the ball striking the head portion stringing. In addition to deviations in ball striking accuracy caused by deflection of the head portion, a ball striking the stringing off the longitudinal axis of the racket causes torsional or twisting motion about the longitudinal axis, thus shifting the line of travel of a struck ball from the desired direction.

The prior art contains tennis racket constructions which implicitly or explicitly attempt to overcome some or all of these struck ball directional inaccuracies. Representative of the prior art are the U.S. Pat. No. 2,481,075 to Brown, U.S. Pat. No. 3,633,910 to Spenle, U.S. Pat. No. 4,192,505 to Tabickman et al, U.S. Pat. No. 4,436,305 to Fernandez, U.S. Pat. No. 4,440,392 to Popplewell and U.S. Pat. Nos. 4,664,380 and 4,768,786 to Kuebler. The approach of the Kuebler patent is to provide the maximum height (measured in a direction normal to the stringing plane) of the racket frame in a triangular or bight region of the throat portion of the frame where it intersections with the head portion and to taper the height both toward the handle portion and the head portion of the racket frame in opposite directions along the longitudinal axis of the racket.

However, there are practical limitations on how much the height of a conventional frame can be increased which may restrict the utility of the approach of the Kuebler patent in overcoming the above-described inaccuracies of a conventional racket frame. One limitation is that increasing the frame height has the disadvantage of increasing the amount of material in the racket frame of conventional construction and thus frame weight in a corresponding fashion.

Consequently, in view of the above-described drawback of the approach of the Kuebler patent to overcoming the struck ball directional inaccuracies of conventional tennis racket frame construction, a need still exists for another approach which will overcome these problems without creating new ones in their place.

SUMMARY OF THE INVENTION

The present invention provides a racket having a multi-frame construction designed to satisfy the aforementioned needs. In contrast to the approach of the Kuebler patent which is to tailor racket frame stiffness by increasing the frame height at certain regions of the conventional frame, the approach of the present invention is to increase stiffness by providing a racket having a multi-frame construction. By provision of the multi-frame construction, it is believed that bending and twisting of the racket frame can be reduced to insignificant levels.

Accordingly, the present invention is directed to a sports racket having a handle and a multi-frame. The multi-frame comprises: (a) a primary frame defining a throat connected to the handle and a hoop-shaped head connected to the throat and encompassing an open region, the head having a plurality of stringing holes defined therethrough for attaching stringing to the head and across the open region; (b) at least one supplementary frame disposed in spaced relation and adjacent to one side of the primary frame and being coextensive with at least a portion of the primary frame; and (c) means for rigidly interconnecting the supplementary frame to the coextensive portion of the primary frame. The interconnecting means and supplementary frame serve to increase the stiffness of the primary frame, reducing axial and torsional deflections thereof upon striking a ball by the stringing across the open region of the head. In one form, the interconnecting means is a plurality of ribs extending between and connecting the supplementary frame to the primary frame.

Also, a pair of supplementary frames are provided, being disposed on opposite sides of the primary frame. The supplementary frames are coextensive with all or a portion of the primary frame head, plus all or a portion of the primary frame throat. Further, the ribs are aligned with the stringing holes through the coextensive portion of the primary frame head. Selected ones of the ribs can be larger in diameter and greater in height than others to vary the combined height of the supplementary and primary frames.

Furthermore, the multi-frame includes supplementary bracing which extends between and interconnects shaft portions of the throat of the primary frame alone. Also, the multi-frame includes supplementary bracing which extends between and interconnects portions of the supplementary frames alone or with portions of the primary frame.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 28 is a plan view of a eighth embodiment of a sports racket with a multi-frame in accordance with the present invention.

FIG. 29 is a side elevational view of the racket as seen along line 29—29 of FIG. 28.

FIG. 30 is an enlarged cross-sectional view taken along line 30—30 of FIG. 28.

FIG. 31 is an enlarged cross-sectional view taken along line 31—31 of FIG. 28.

FIG. 32 is an enlarged cross-sectional view taken along line 32—32 of FIG. 28.

DETAILED DESCRIPTION OF THE INVENTION

Figure 1:
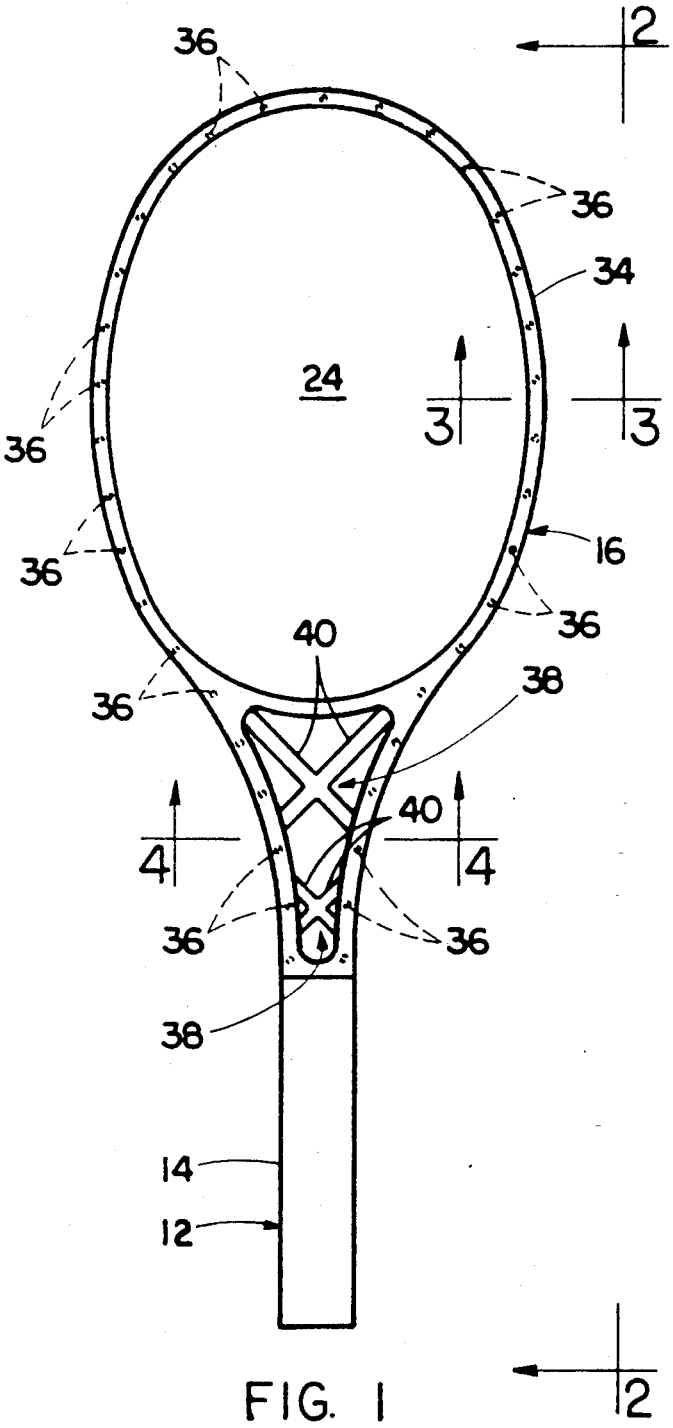
FIG. 1 is a plan view of a first embodiment of a sports racket with a multi-frame in accordance with the present invention.

In the following description, like reference characters designate like or corresponding parts throughout the several views. Also, in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1-4, there is shown a first of several embodiments of a tennis racket, generally indicated by the numeral 10 and constructed in accordance with the principles of the present invention. While the constructional principles of the present invention are illustrated and described in conjunction with a tennis racket, they are believed to be equally applicable to the rackets used in playing other sports comparable to tennis, such as squash and badminton. Therefore, the reference hereafter to a tennis racket should be construed in a generic sense as applicable to other sport rackets.

The racket 10 has a convention handle 12 which includes an outer sheath 14 for facilitating gripping of the racket by the user's hand. In addition to the conventional handle 12, the sports racket 10 has a multi-frame 16 constructed in accordance with the principles of the present invention. The handle 12 and multi-frame 16 can be fabricated of composite-type material composed of high modulus fibers such as graphite fibers or glass fibers in a matrix of an epoxy resin. Alternatively, they can be fabricated from other materials, such as aluminum, wood and plastics.

In all embodiments of the racket 10, the multi-frame 16 includes a main or primary frame 18. The primary frame 18 has a pair of opposite sides and defines a throat 20 connected to the handle 12 and a hoop-shaped head 22 connected to the throat 20 and encompassing an open region 24. The throat 20 of the primary frame 18 is in the form of a pair of shafts 26 spaced apart in a generally V-shaped configuration. At their converging ends, the shafts 26 of the throat 20 are connected together and then merge with the handle 12, whereas at their diverging ends, the shafts are connected to and merge with the head 22.

In all embodiments of the racket 10, the hoop-shaped head 22 of the primary frame 18 has a round or oval configuration and contains a plurality of stringing holes 28. The stringing holes 28 are spaced apart about the head 22 and open outwardly at a narrow recess 30 formed in an outwardly facing surface 22A of the head 22. The stringing holes 28 open inwardly toward one another and are aligned in a common plane lying between the opposite sides of the primary frame 18. In a conventional manner, stringing (not shown) can be applied under tension through the holes 28 and across the open region 24 encompassed by the head 22 to form a grid pattern across the head, providing a ball striking area of the racket 10. The recess 30 is provided to protect the outer exposed portions of the stringing located at the stringing holes 28. Typically, the holes 28 have grommets 32 mounted in them through which the stringing is threaded.

Figure 5:
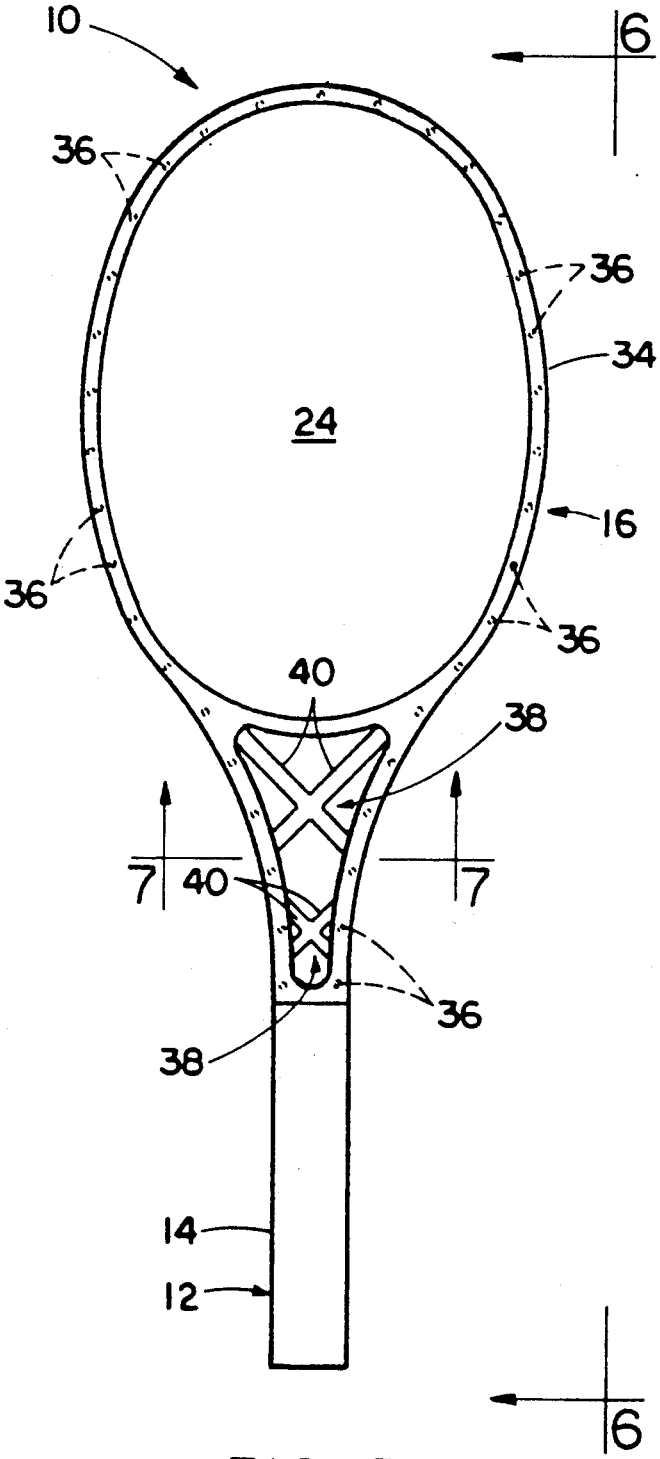
FIG. 5 is a plan view of a second embodiment of a sports racket with a multi-frame in accordance with the present invention.
Figure 8:
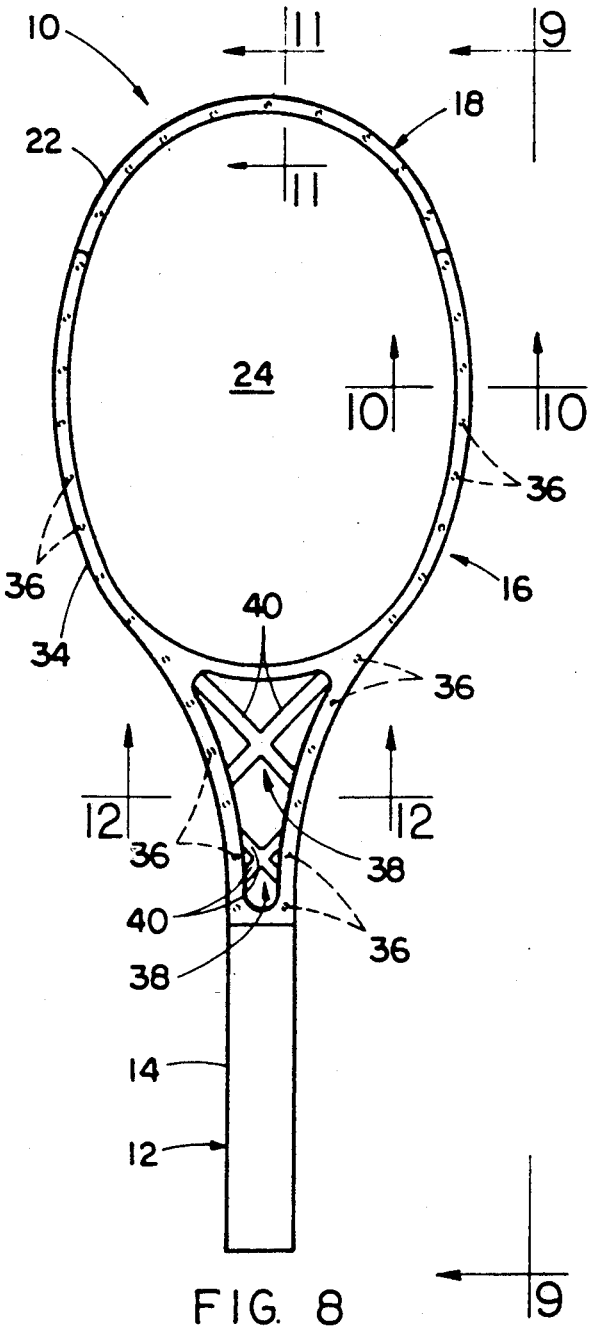
FIG. 8 is a plan view of a third embodiment of a sports racket with a multi-frame in accordance with the present invention.
Figure 13:
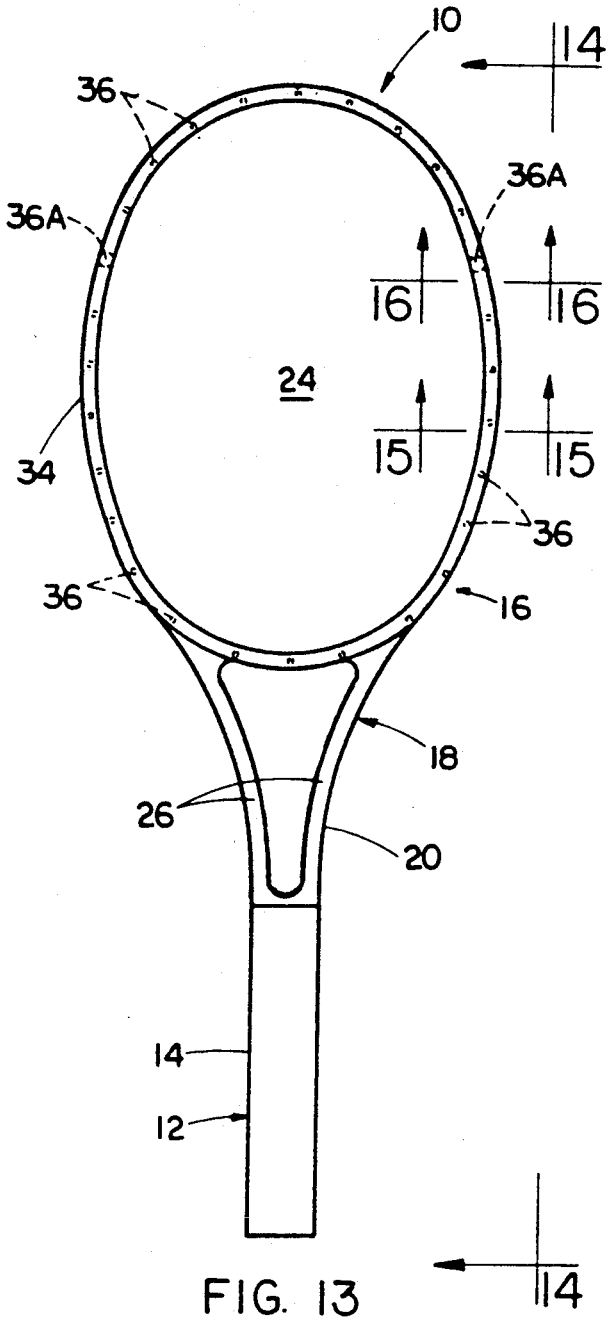
FIG. 13 is a plan view of a fourth embodiment of a sports racket with a multi-frame in accordance with the present invention.
Figure 14:
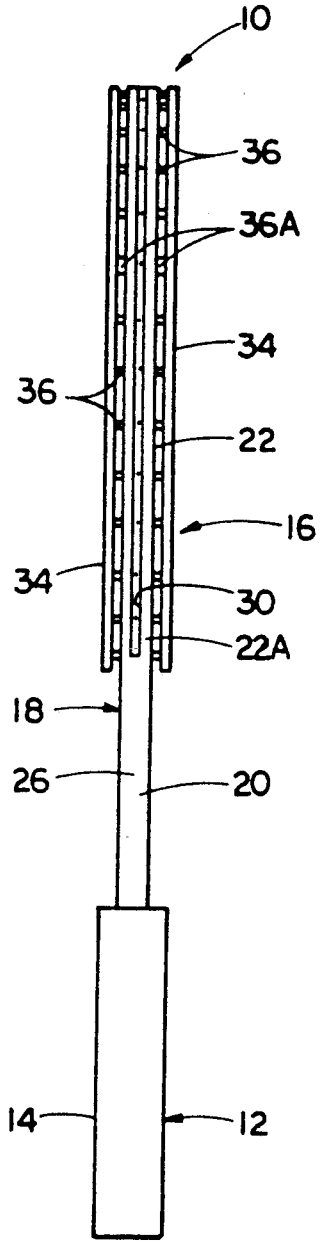
FIG. 14 is a side elevational view of the racket as seen along line 14—14 of FIG. 13.
Figure 15:
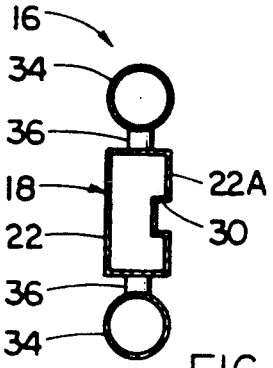
FIG. 15 is an enlarged cross-sectional view taken along line 15—15 of FIG. 13.
Figure 16:
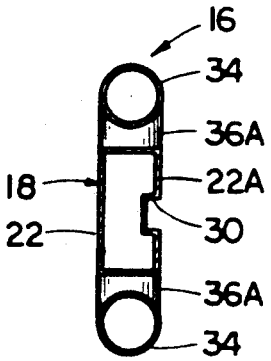
FIG. 16 is an enlarged cross-sectional view taken along line 16—16 of FIG. 13.
Figure 17:
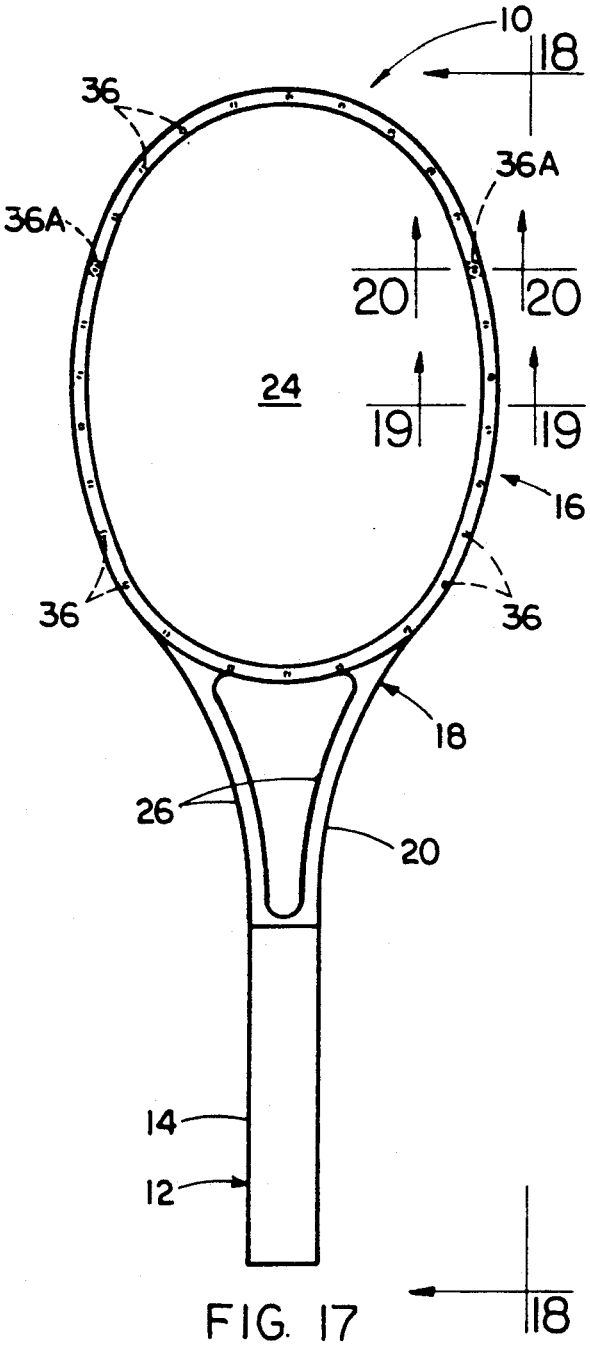
FIG. 17 is a plan view of a fifth embodiment of a sports racket with a multi-frame in accordance with the present invention.
Figure 18:
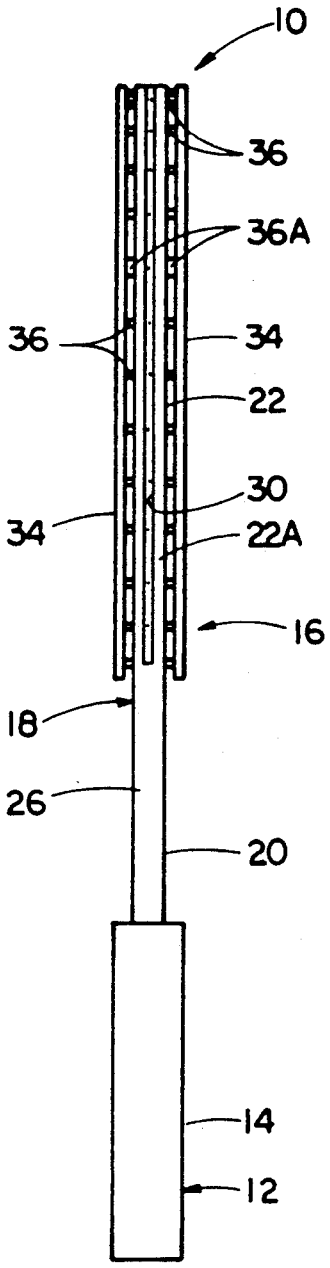
FIG. 18 is a side elevational view of the racket as seen along line 18—18 of FIG. 17.
Figure 21:
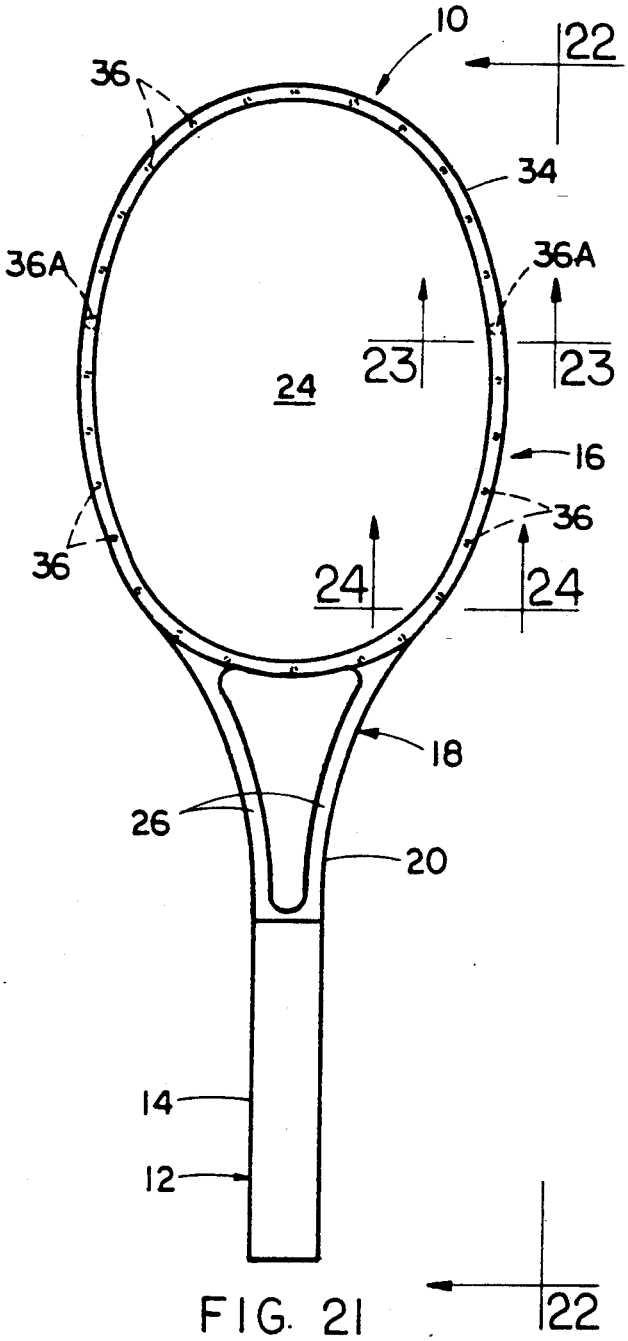
FIG. 21 is a plan view of a sixth embodiment of a sports racket with a multi-frame in accordance with the present invention.
Figure 22:
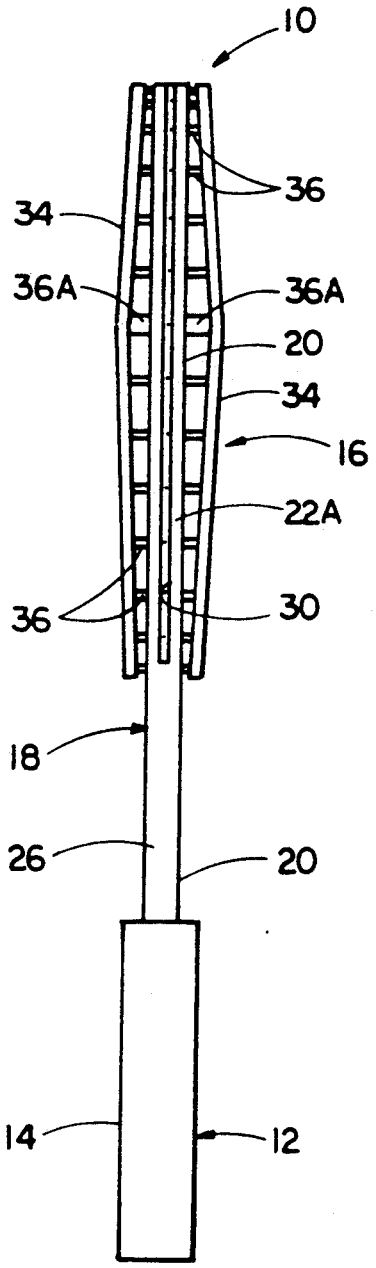
FIG. 22 is a side elevational view of the racket as seen along line 22—22 of FIG. 21.
Figure 23:
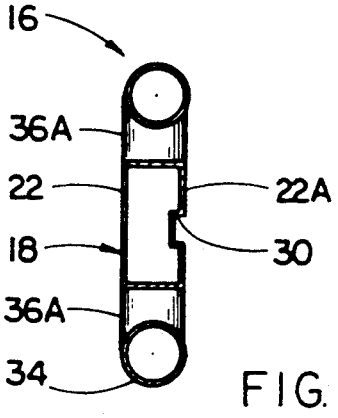
FIG. 23 is an enlarged cross-sectional view taken along line 23—23 of FIG. 21.
Figure 24:
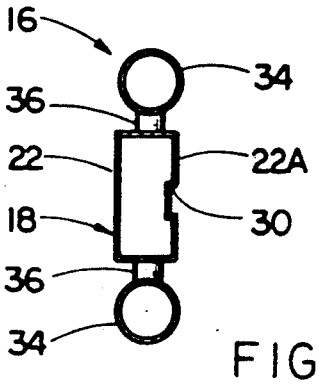
FIG. 24 is an enlarged cross-sectional view taken along line 24—24 of FIG. 21.

Also, in the first through eighth embodiments of the racket 10, the multi-frame 16 includes at least one and preferably multiple, such as a pair of, supplementary frames 34. The supplementary frames 34 generally identical to one another are disposed adjacent to the opposite sides of the primary frame 18. The supplementary frames 34 are coextensive with all or a portion of the head 22 of the primary frame 18, plus all or a portion of the throat 20 thereof, depending upon the particular embodiment of the racket 10. For instance, in the first embodiment of FIGS. 1 and 2, second embodiment of FIGS. 5 and 6, seventh embodiment of FIGS. 25 and 26, and eighth embodiment of FIGS. 28 and 29, the supplementary frames 34 are coextensive with or cover the entire primary frame 18, that is, the entire throat 20 and head 22. In the third embodiment of FIGS. 8 and 9, the supplementary frames 34 are coextensive with or cover the entire throat 20 and all but the extreme upper portion of the head 22 of the primary frame 18. In the fourth embodiment of FIGS. 13 and 14, fifth embodiment of FIGS. 17 and 18, and sixth embodiment of FIGS. 21 and 22, the supplementary frames 34 are coextensive with or cover only the entire head 22 of the primary frame 18 and not the throat 20 thereof.

With respect to all embodiments of the racket 10 with multi-frame 16 having the supplementary frames 34, the lengths and widths of the supplementary frames 34, as seen in plan view, are generally the same as the coextensive portions of the primary frame 18, making the plan configurations of the supplementary frames 34 substantially complementary to such coextensive primary frame portions. Further, with respect to all embodiments of the multi-frame 16, the supplementary frames 34 have a substantially uniform height in the direction normal to the plane of the primary frame 18, as seen in profile or side view, which is substantially less than the height of the primary frame.

Figure 2:
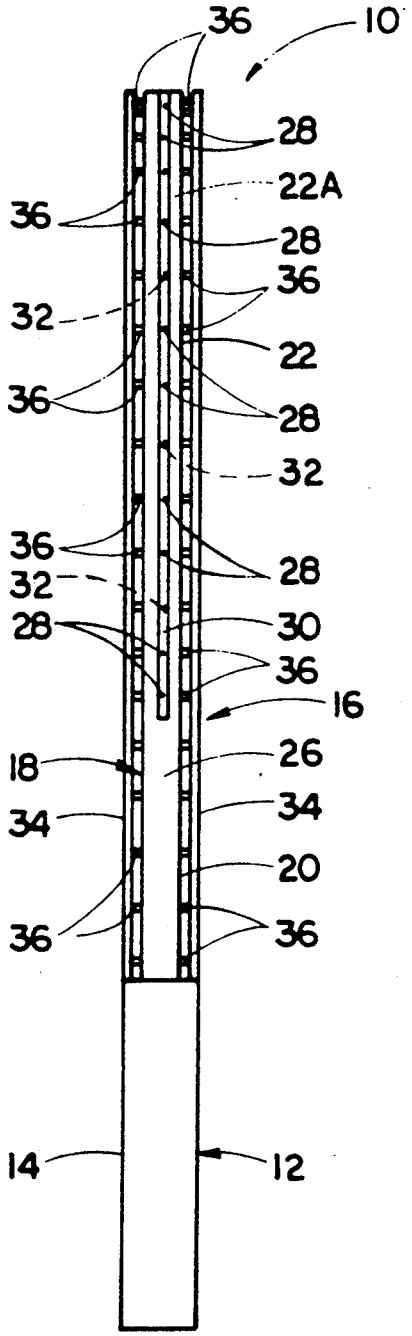
FIG. 2 is a side elevational view of the racket as seen along line 2—2 of FIG. 1.
Figure 6:
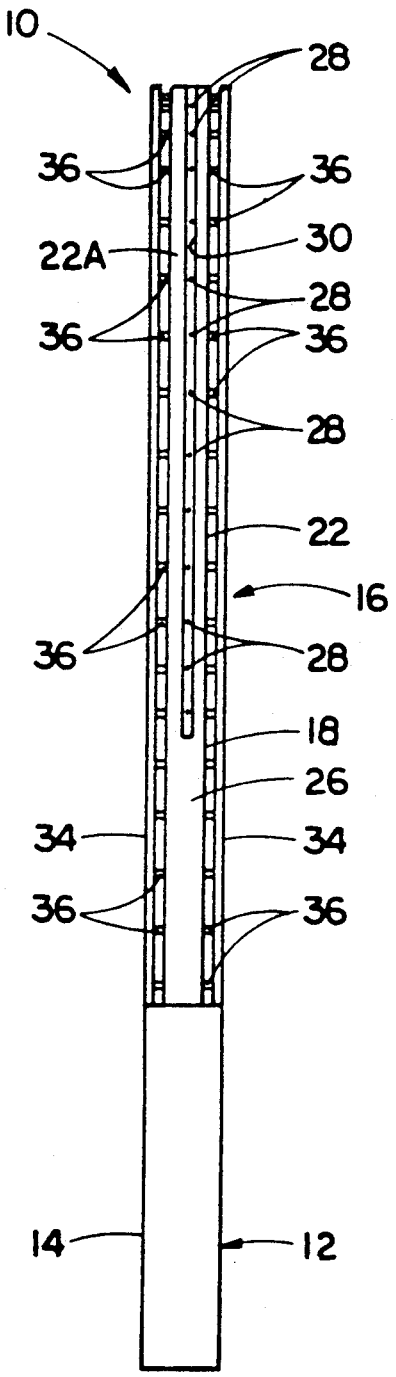
FIG. 6 is a side elevational view of the racket as seen along line 6—6 of FIG. 5.
Figure 9:
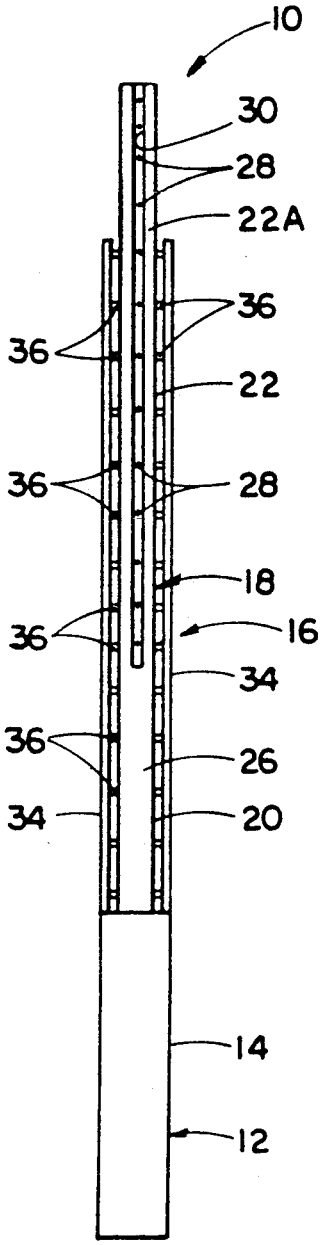
FIG. 9 is a side elevational view of the racket as seen along line 9—9 of FIG. 8.
Figure 10:
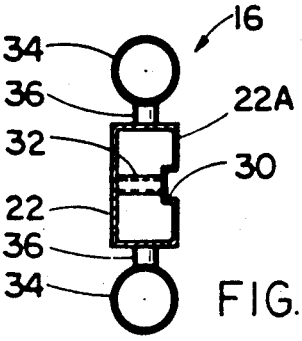
FIG. 10 is an enlarged cross-sectional view taken along line 10—10 of FIG. 8.
Figure 11:
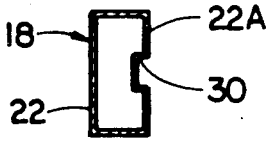
FIG. 11 is an enlarged cross-sectional view taken along line 11—11 of FIG. 8.

Further, all embodiments of the racket multi-frame 16 having supplementary frames 34 include means for disposing and interconnecting the supplementary frames 34 in spaced relation to the primary frame 18. The interconnecting means preferably takes the form of a plurality of ribs 36 spaced from one another, and extending between and rigidly interconnecting the supplementary frame 34 with the coextensive portion of the primary frame 18. The ribs 36 and supplementary frames 34 together serve to increase the stiffness of the primary frame 18, reducing axial and torsional deflections thereof upon striking a ball by the stringing across the open region 24 of the primary frame head 22. Preferably, those of the ribs 36 connected to the coextensive portion of the primary frame head 22 are aligned with the stringing holes 28 therethrough, as seen in FIGS. 2, 6 and 9, extending in perpendicular relation thereto.

When a ball strikes the stringing (not shown) of the racket 10 with multi-frame 16, the resulting force is transmitted to the primary frame 18 through the individual strings. By locating the ribs 36 connecting the primary frame 18 to the supplementary frames 34 aligned with the centerlines of the stringing holes 28, forces transmitted to the primary frame 18 pass directly through the ribs 36 and into the supplementary frames 34 thus reducing the bending deflection in the multi-frame 16 due to the greater moment of inertia cross section where ball-striking forces enter the primary frame 18. The high moment of inertia cross section at the load point consists of the primary frame 18, the ribs 36 and the supplementary frames 34. By selecting the proper rib height, the height of the primary frame 18 can be reduced to less than the frame height of a conventional racket and the supplementary frame heights can be minimized with the resulting configuration possessing increased stiffness. This racket with multi-frame concept can produce improved performance with equal or less weight than conventional rackets. Further, increasing the moment of inertia/stiffness is accompanied by an inherently higher natural frequency. Consequently, the racket head resonance frequency will approach the period of time for which a ball is in contact with the stringing and, therefore, contribute to improving ball-striking accuracy and power.

Figures 25, 26, 27:
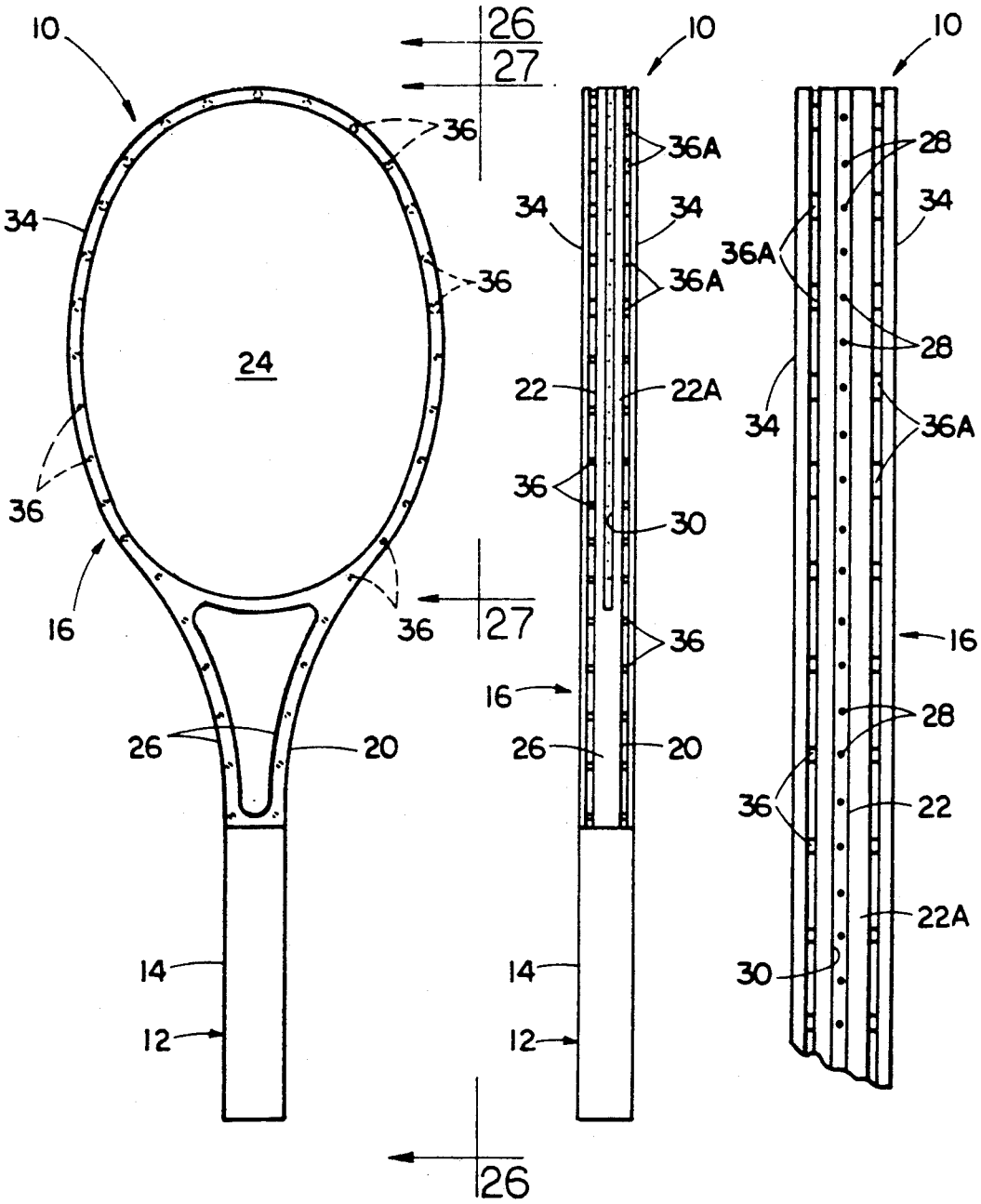
FIG. 25 is a plan view of a seventh embodiment of a sports racket with a multi-frame in accordance with the present invention.
FIG. 26 is a side elevational view of the racket as seen along line 26—26 of FIG. 25.
FIG. 27 is an enlarged view of an upper portion of the multi-frame of the racket seen in FIG. 26.

Alternatively, although not preferred, the ribs 36 can be offset between the stringing holes 28, as seen in FIG. 27. Further, the ribs 36 can spaced from one another at equal distances, as seen in FIG. 2, 6, and 9 or at unequal distances, as seen in FIGS. 26 and 27. Additionally, the ribs 36 can be equal in diameter and height, as seen in FIGS. 2, 6 and 9. Alternatively, selected ones of the ribs 36A, seen in FIGS. 14, 16, 18, 20, 22, 23 and 29 can be larger in diameter than others. Location of such larger ribs 36A as shown tends to make the center of percussion and center of gravity approach the center of the head 22. Or, the ribs 36 one to the next can have gradually increasing and decreasing diameter sizes, as seen in FIGS. 26 and 27.

Figure 19:
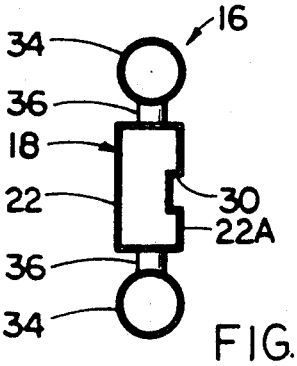
FIG. 19 is an enlarged cross-sectional view taken along line 19—19 of FIG. 17.
Figure 20:
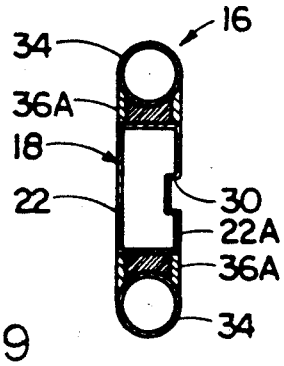
FIG. 20 is an enlarged cross-sectional view taken along line 20—20 of FIG. 17.

Furthermore, the ribs 36 can have different heights, as seen in FIGS. 22–24 and 29, in order to vary the overall height of the primary and supplementary frames 18, 34 combined with the ribs 36. This arrangement can be used to reduce the mass of the primary frame 18 and to shape the contour of the supplementary frames 34 and achieve desired stiffness. The ribs 36 can be hollow, as seen in FIG. 19, or solid, as seen in FIG. 20, being filled with a high density material, to again shift the mass of the racket as desired.

The ribs 36 and supplementary frames 34 can be permanently attached to the primary frame 18. Alternatively, the ribs 36 and supplementary frames 34 can be detachable for interchanging different configurations of ribs and supplementary frames.

Furthermore, in the first to third and eighth embodiments of the racket 10, the multi-frame 16 includes supplementary bracing 38 in addition to the primary and supplementary frames 18, 36. In the ninth to twelveth embodiments of the racket 10, the multi-frame 16 includes only supplementary bracing 38 in addition to the primary frame 18. The supplementary bracing 38 is composed of multiple cross members 40 of various configurations.

Figure 4:
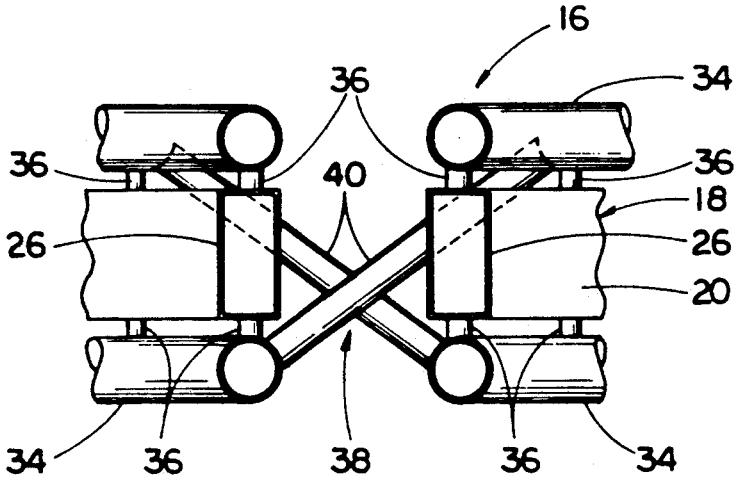
FIG. 4 is an enlarged cross-sectional view taken along line 4—4 of FIG. 1.
Figure 3:
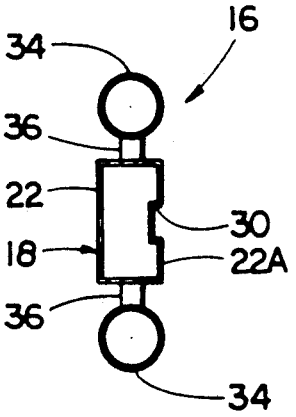
FIG. 3 is an enlarged cross-sectional view taken along line 3—3 of FIG. 1.
Figure 7:
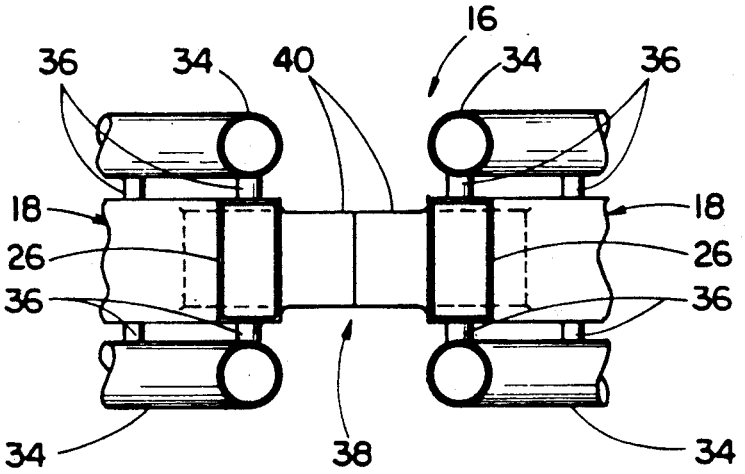
FIG. 7 is an enlarged cross-sectional view taken along line 7—7 of FIG. 5.
Figure 12:
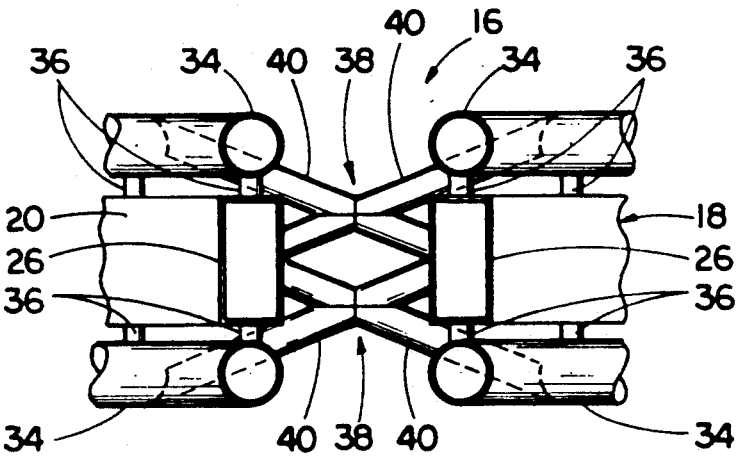
FIG. 12 is an enlarged cross-sectional view taken along line 12—12 of FIG. 8.
Figure 33:
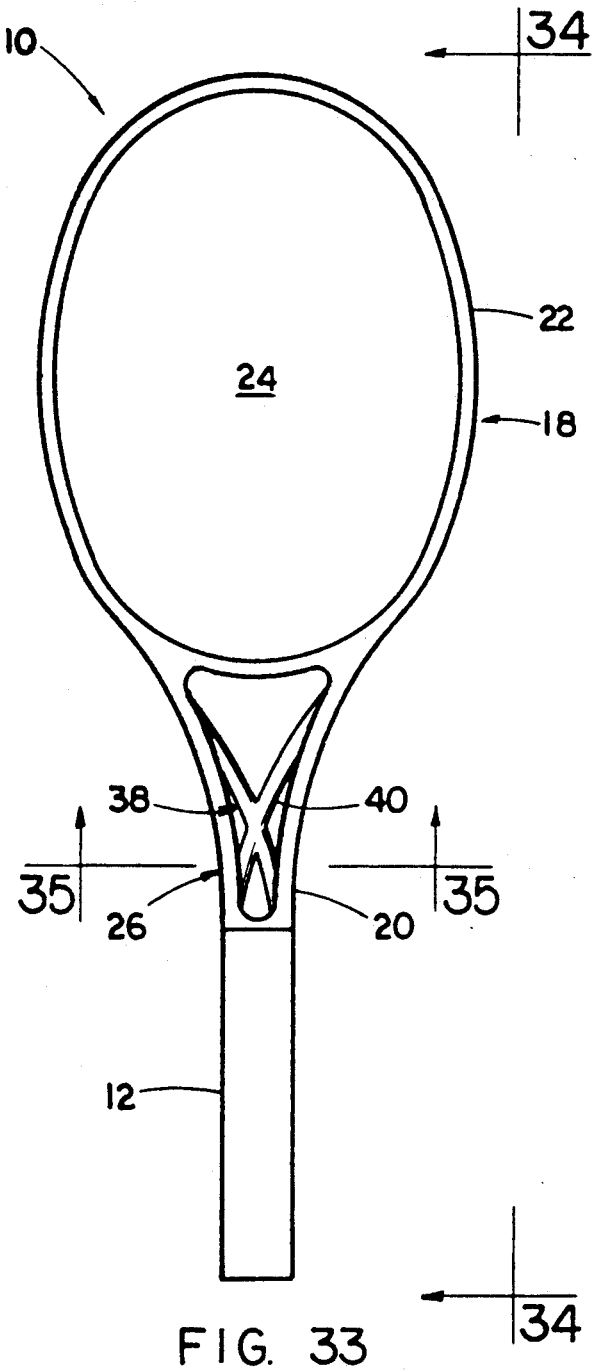
FIG. 33 is a plan view of a ninth embodiment of a sports racket with a multi-frame in accordance with the present invention.
Figure 34:
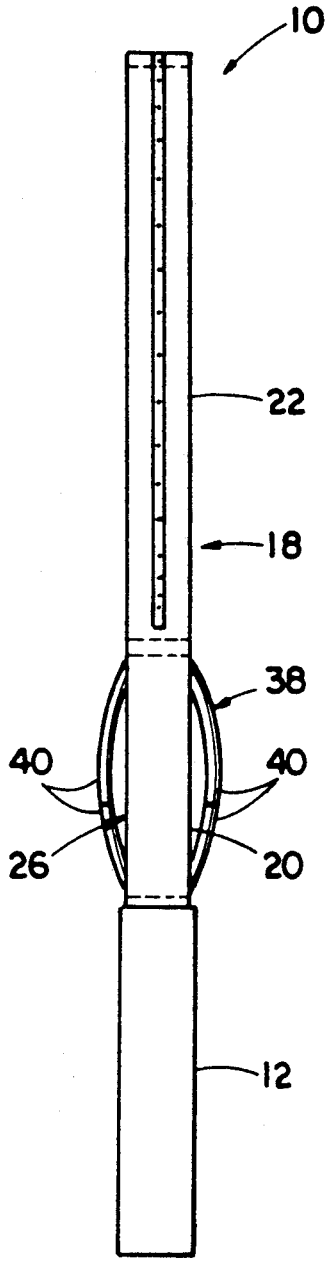
FIG. 34 is a side elevational view of the racket as seen along line 34—34 of FIG. 33.
Figure 35:
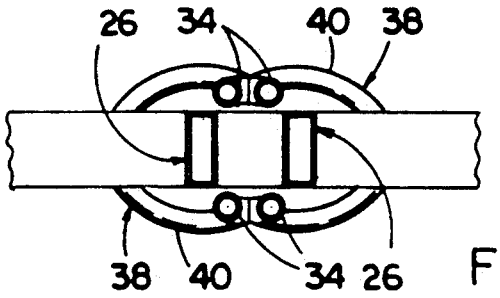
FIG. 35 is an enlarged cross-sectional view taken along line 35—35 of FIG. 33.
Figure 36:
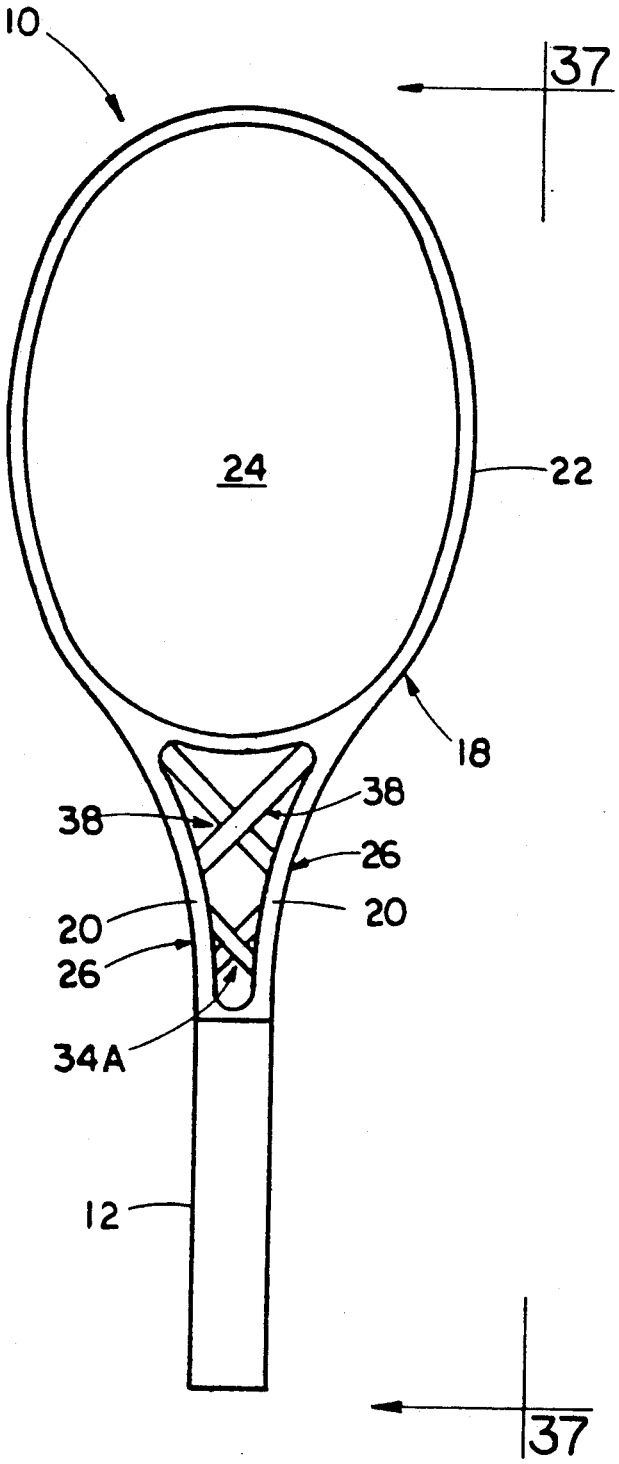
FIG. 36 is a plan view of a tenth embodiment of a sports racket with a multi-frame in accordance with the present invention.
Figure 37:
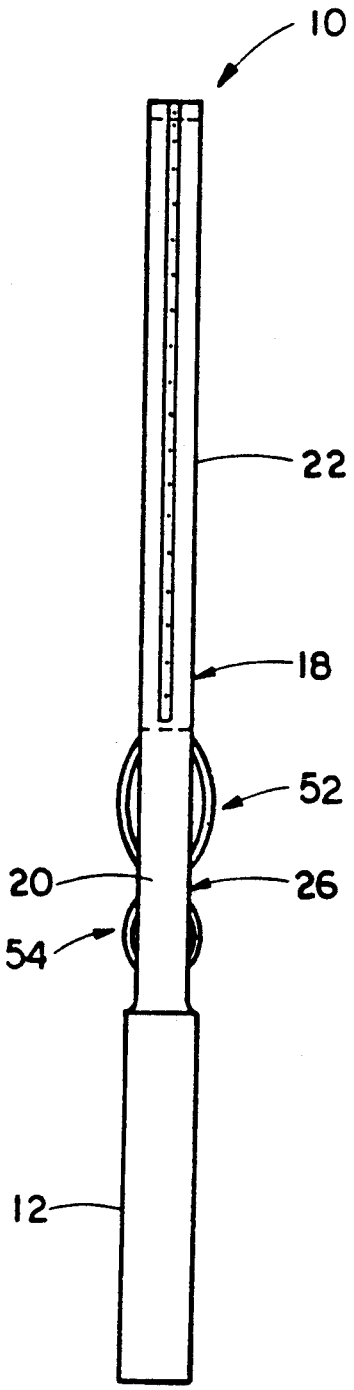
FIG. 37 is a side elevational view of the racket as seen along line 37—37 of FIG. 36.
Figure 38:
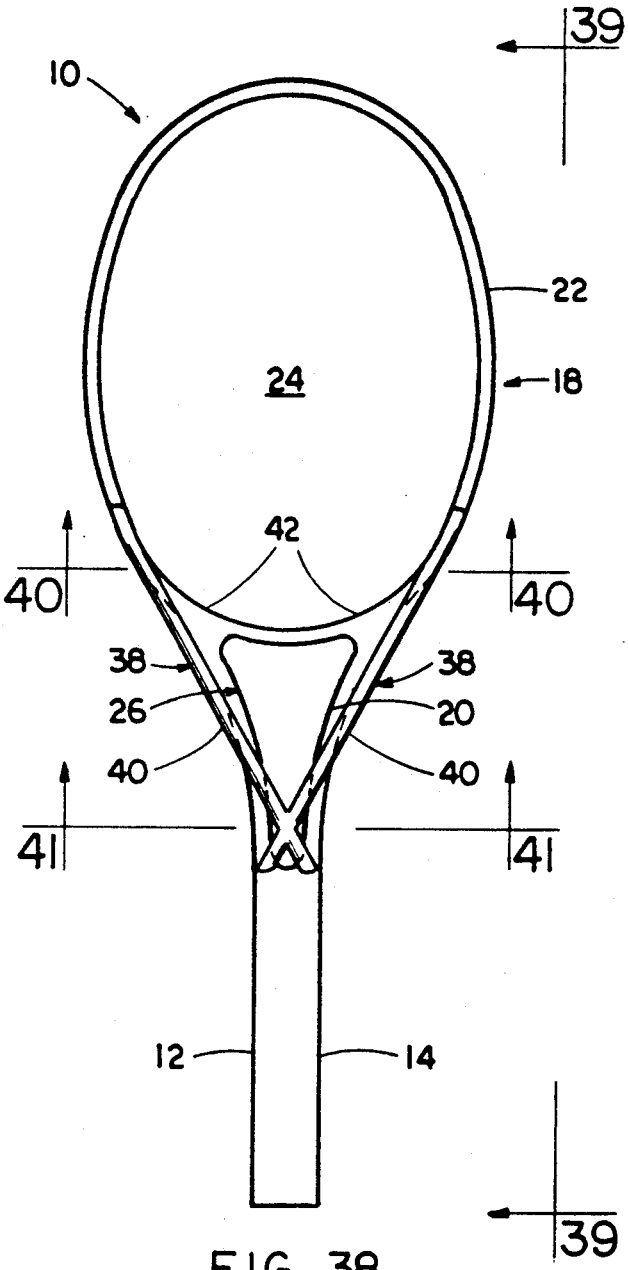
FIG. 38 is a plan view of an eleventh embodiment of a sports racket with a multi-frame in accordance with the present invention.
Figure 39:
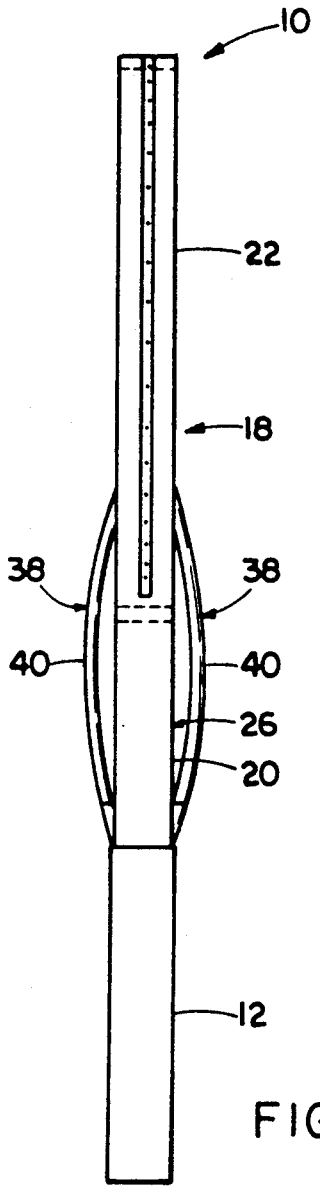
FIG. 39 is a side elevational view of the racket as seen along line 39—39 of FIG. 38.
Figure 40:
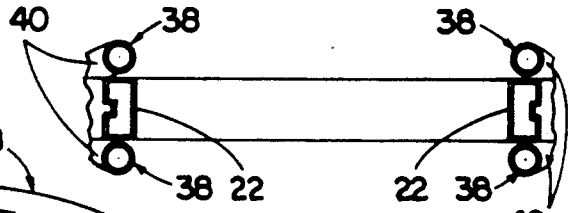
FIG. 40 is an enlarged cross-sectional view taken along line 40—40 of FIG. 38.
Figure 41:
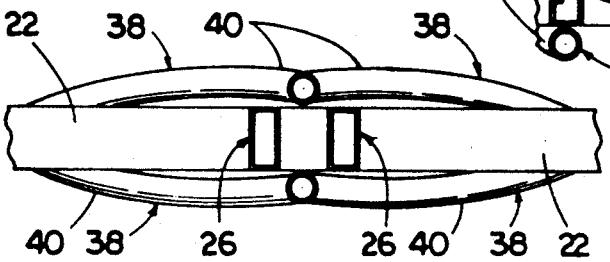
FIG. 41 is an enlarged cross-sectional view taken along line 41—41 of FIG. 38.

In the first embodiment of the racket 10 seen in FIGS. 1 and 4, cross members 40 of the supplementary bracing 38 extend between and rigidly interconnect diagonally opposite portions of supplementary frames 34 adjacent the throat 20 of the primary frame 18, but does not connect with the primary frame. In the second embodiment seen in FIGS. 5 and 7, eighth embodiment seen in FIGS. 28 and 32, ninth embodiment seen in FIGS. 33–35, and tenth embodiment seen in FIGS. 36 and 37, the cross members 40 of the supplementary bracing 38 extend diagonally between, such as in orthogonal relation to one another, and rigidly interconnect opposite portions of the throat shafts 26 of the primary frame 18 only. Further, in the ninth and tenth embodiments, the cross members 40 on opposite sides of the primary frame 18 project or bow outwardly in opposite directions from the common plane of the primary frame 18. In the third embodiment seen in FIGS. 8 and 12, the cross members 40 of the supplementary bracing 38 extend between and rigidly interconnect opposite portions of the primary and supplementary frames 18, 34.

Figure 42:
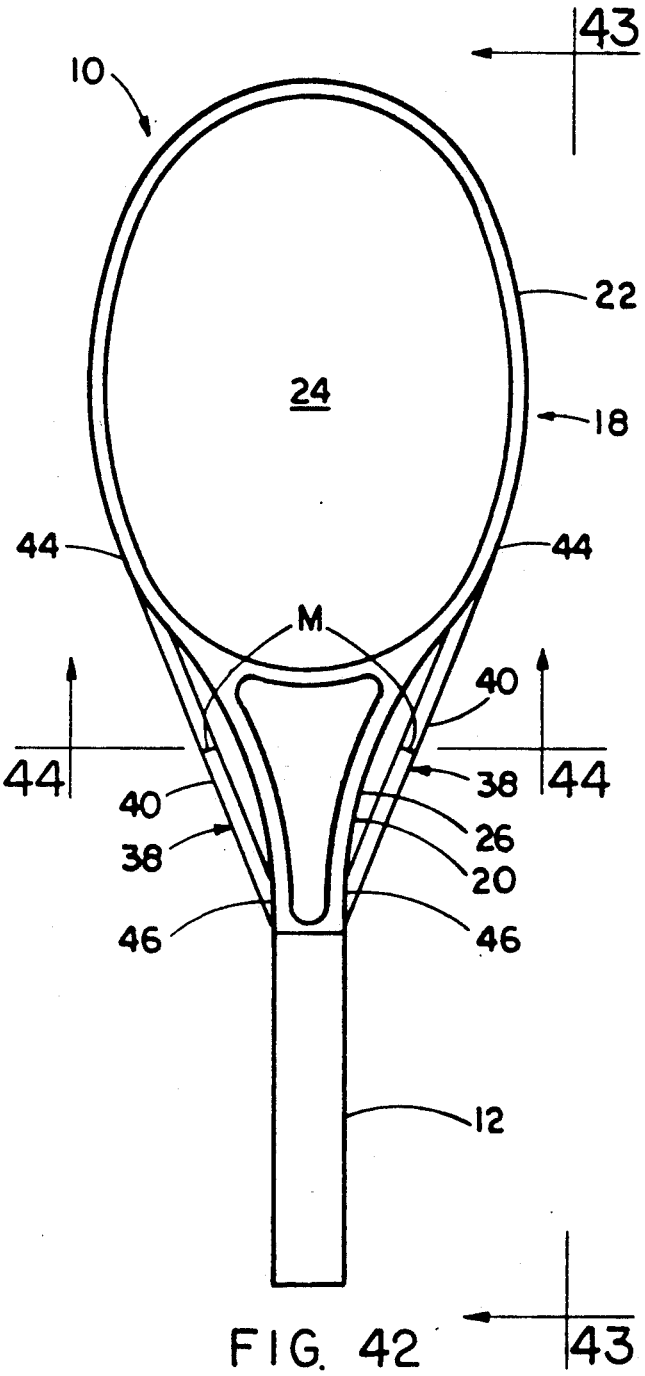
FIG. 42 is a plan view of a twelveth embodiment of a sports racket with a multi-frame in accordance with the present invention.
Figure 43:
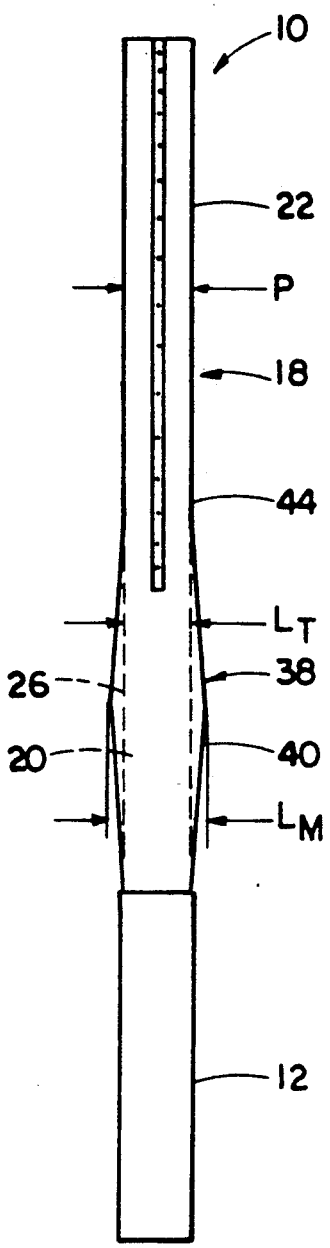
FIG. 43 is a side elevational view of the racket as seen along line 43—43 of FIG. 42.
Figure 44:
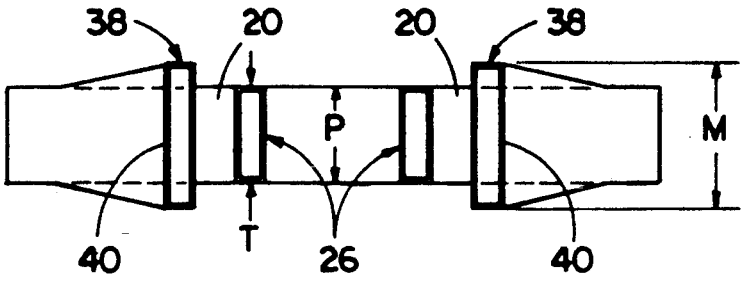
FIG. 44 is an enlarged cross-sectional view taken along line 44—44 of FIG. 42.

In the eleventh embodiment seen in FIGS. 38–41 and twelveth embodiment seen in FIGS. 42–44, the cross members 40 of the supplementary bracing 38 extend between and rigidly interconnect the base portion 42 of the head 22 with the throat shafts 26 adjacent the handle 12. More particularly, in the eleventh embodiment, the respective cross members 40 of the supplementary bracing 38 project or bow outwardly in opposite directions from the primary frame 18 and extend from either side of the primary frame head 22 diagonally, crossing outwardly of the throat 20 of the primary frame 18 and rigidly connecting to either side of the throat 20 near the handle 12 of the racket 10. In the twelveth embodiment, the respective cross members 40 of the supplementary tracing 38 rigidly interconnect the outer sides or surfaces 44 of the head 22 with the outer sides or surfaces 46 of the throat shafts 26 of the primary frame 18. As seen in FIGS. 42–44, the respective cross members 40 of the supplementary bracing 38 progressively taper from each end thereof, where they connect at one end to the outer surface 44 of the head 22 and at the other end to the outer surfaces 46 of the throat shafts 26, toward the respective mid-sections of the cross members 40 wherein they reach a maximum height "M" which is the cross-sectional height of the cross members 40 measured in a direction perpendicular or normal to the common plane of the primary frame 18. Furthermore, the maximum height "M" of each cross member 40 is greater than the maximum height "T" of the throat shafts 26 and greater than the maximum height "P" of the primary frame 18 wherein the maximum heights "T" and "P" are measured in a direction perpendicular or normal to the common plane of the frame 18.

When a ball strikes the stringing of the multi-frame racket 10 either side of the longitudinal axis thereof, the eccentric load causes a torque or twisting action which is transmitted from the head 22 to the shafts 26 of the throat 20. This rotation out of the normal plane of the multi-frame 16 affects the ball-striking accuracy in a similar manner to that caused by bending along the longitudinal axis. The twisting encountered in conventional rackets is reduced in the multi-frame racket 10 of the present invention by the stiffening effect of the supplementary frames 34 and the cross members 40 of the supplementary bracing 38 and virtually eliminated by cross-linking the opposite supplementary frames in the throat 20 by the forty-five degree cross members 40 of the supplementary bracing 38.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a sports racket having a handle, a multi-frame comprising:

(a) a primary frame having a pair of opposite sides and defining a throat connected to said handle and a hoop-shaped head connected to said throat and encompassing an open region, said throat and head of said frame being generally aligned with one another, said throat having shafts with portions spaced apart, said head having a plurality of stringing holes defined therethrough for attaching stringing to said head and across the open region, said stringing holes being aligned in a common plane lying between said opposite sides of said primary frame; and (b) supplementary bracing including at least one pair of cross members extending between and rigidly interconnecting said spaced portions of said throat shafts, said cross members rigidly connected at their ends of said throat shafts and projecting in opposite directions away from one another and outwardly beyond said opposite sides of said primary frame for increasing the stiffness of said primary frame to thereby reduce axial and torsional deflections thereof upon striking a ball by the stringing across said open region of said primary frame head.

2. The racket as recited in claim 1, wherein said cross members extend between diagonally opposite portions of said throat shafts.

3. The racket as recited in claim 1, wherein said cross members extend in orthogonal relation to one another.

4. The racket as recited in claim 1, wherein said cross members are spaced from one another.

5. The racket as recited in claim 1, wherein said cross members bow outwardly in opposite directions from said plane of said primary frame.

6. The racket as recited in claim 1, wherein said supplementary bracing comprises first and second pairs of said cross members.

7. The racket as recited in claim 6, wherein said first pair of cross members are disposed adjacent said head of said frame.

8. The racket as recited in claim 6, wherein said second pair of cross members are disposed adjacent said handle.

9. In a sports racket having a handle, a multi-frame comprising:

(a) a primary frame having a pair of opposite sides and defining a throat connected to said handle and a hoop-shaped head connected to said throat and encompassing an open region, said throat and head of said frame being generally aligned with one another, said throat having shafts with portions spaced apart, said head having a plurality of stringing holes defined therethrough for attaching stringing to said head and across the open region, said stringing holes being aligned in a common plane lying between said opposite sides of said primary frame; and (b) supplementary bracing including at least one pair of cross members extending over and rigidly interconnecting said spaced portions of said throat shafts with said head, said cross members rigidly connected at their ends to said throat shafts and said head and projecting in opposite directions away from one another and outwardly beyond said opposite sides of said primary frame for increasing the stiffness of said primary frame to thereby reduce axial and torsional deflections thereof upon striking a ball by the stringing across said open region of said primary frame head.

10. The racket as recited in claim 9, wherein said cross members extend between diagonally opposite portions of said throat shafts and said head.

11. In a sports racket having a handle, a multi-frame comprising:

(a) a primary frame having a pair of opposite sides and defining a throat connected to said handle and a hoop-shaped head connected to said throat and encompassing an open region, said throat and head of said frame being generally aligned with one another, said throat having shafts with portions spaced apart, said head having a plurality of stringing holes defined therethrough for attaching stringing to said head and across the open region, said stringing holes being aligned in a common plane lying between said opposite sides of said primary frame; and (b) supplementary bracing rigidly interconnecting outer surfaces of said throat shafts near said handle with outer surfaces of said primary head for increasing the stiffness of said primary frame to thereby reduce axial and torsional deflections thereof upon striking a ball by the stringing across said open region of said primary frame head, said supplementary bracing including at least one pair of brace members with one of said brace members being disposed along one side-surface of said racket and the other of said brace members being disposed along the other opposite side-surface of said racket, each brace member increasing progressively outwardly from each end thereof towards its mid-section to a maximum height being measured in a direction perpendicular to said common plane of said frame.

12. The racket as recited in claim 11, wherein the maximum height of said brace members is greater than the maximum height, measured in a direction perpendicular to said common plane, of said hoop-shaped head of said primary frame.

13. The racket as recited in claim 11, wherein the maximum height of said brace members is greater than the maximum height, measured in a direction perpendicular to said common plane, of said throat shafts of said primary frame.

14. The racket as recited in claim 11, wherein a portion of said brace members projects outwardly beyond said opposite sides of said primary frame with the maximum height of said brace members being located along said outwardly projecting portion and being greater than the maximum height, measured in a direction perpendicular to said common plane, of said hoop-shaped head or said throat shafts of said primary frame.

15. In a sports racket having a handle, a multi-frame comprising:

(a) a primary frame having a pair of opposite sides and defining a throat connected to said handle and a hoop-shaped head connected to said throat and encompassing an open region, said throat and head of said frame being generally aligned with one another, said throat having shafts with portions spaced apart, said head having a plurality of stringing holes defined therethrough for attaching stringing to said head and across the open region, said stringing holes being aligned in a common plane lying between said opposite sides of said primary frame; and (b) supplementary bracing rigidly interconnecting said throat shafts with said head of said primary frame for increasing the stiffness of said primary frame to thereby reduce axial and torsional deflections thereof upon striking a ball by the stringing across said open region of said primary frame head, said supplementary bracing bowing away from said common plane of said primary frame and having at least a portion thereof projecting outwardly in a direction perpendicular to said common plane, beyond at least one of said opposite sides of said frame.

16. The racket as recited in claim 15, wherein said supplementary bracing includes at least a pair of brace members with one of said brace members being disposed along one side-edge of said racket and the other of said brace members being disposed along the other opposite side-edge of said racket.

17. The racket as recited in claim 15, wherein said supplementary bracing includes at least one pair of brace members with each brace member being rigidly connected at one end to end of said throat shafts adjacent said handle and extending therefrom to a base portion of said primary head frame.

18. The racket as recited in claim 17, wherein said brace members extend diagonally over and across said throat shaft portions.

19. The racket as recited in claim 17, wherein said brace members extend in orthogonal relation to one another.

20. The racket as recited in claim 15, wherein said supplementary bracing includes a pair of brace members disposed along each opposite side of said racket, said brace member pairs on opposite sides of said primary frame bowing outwardly from said common plane of said primary frame and away from one another.

* * * * *